US006318729B1

(12) United States Patent
Pitts, Jr. et al.

(10) Patent No.: US 6,318,729 B1
(45) Date of Patent: Nov. 20, 2001

(54) SEAL ASSEMBLY WITH THERMAL EXPANSION RESTRICTER

(75) Inventors: Charles E. Pitts, Jr., Conroe; Merle L. Bell, Spring; Scott C. Schuette, Pasadena; Jesus Martinez, Houston, all of TX (US)

(73) Assignee: Greene, Tweed of Delaware, Inc., Wilmington, DE (US)

( * ) Notice: Subject to any disclaimer, the term of this patent is extended or adjusted under 35 U.S.C. 154(b) by 0 days.

(21) Appl. No.: 09/489,211

(22) Filed: Jan. 21, 2000

(51) Int. Cl.[7] ..... F16J 15/18; F16J 15/20; E21B 34/14; E21B 33/128

(52) U.S. Cl. ..... 277/511; 277/529; 277/530; 277/534; 277/342; 166/332.4

(58) Field of Search ..... 277/322, 323, 277/326, 337, 342, 510, 511, 518, 529, 530, 531, 532, 534, 535, 541; 166/332.4

(56) References Cited

U.S. PATENT DOCUMENTS 2,264,147 * 11/1941 Dunlevy .
2,968,516 * 1/1961 Jarvis .
3,096,660 * 7/1963 Hausner .
3,342,500 * 9/1967 Kundson .
3,944,306 * 3/1976 Neilson .
4,040,636 * 8/1977 Albertson et al. .
4,066,128 1/1978 Davis et al. .
4,169,604 * 10/1979 Heathcott .
4,234,197 11/1980 Amancharla .
4,320,803 3/1982 Manderscheid .
4,512,410 4/1985 Forester .
4,527,806 * 7/1985 Ungchusri et al. .
4,576,385 3/1986 Ungchusri et al. .
4,612,985 9/1986 Rubbo et al. .
4,844,411 * 7/1989 Nelson .
4,848,777 7/1989 Zollo et al. .
5,052,492 10/1991 Torstensson .
5,156,220 10/1992 Forehand et al. .
5,263,683 11/1993 Wong .
5,271,468 12/1993 Streich et al. .
5,297,805 3/1994 Merkin et al. .
5,309,993 5/1994 Coon et al. .
5,316,084 5/1994 Murray et al. .
5,577,739 * 11/1996 Ciotola .
5,611,547 * 3/1997 Baugh et al. .
5,711,372 1/1998 Stokley .

* cited by examiner

*Primary Examiner*—Lynne H. Browne
*Assistant Examiner*—Vishal Patel
(74) *Attorney, Agent, or Firm*—Akin, Gump, Strauss, Hauer & Feld, L.L.P.

(57) ABSTRACT

A seal assembly having a first seal with a first mating surface and a recess in the first mating surface, and a second seal having a second mating surface and a recess in the second mating surface. The first mating surface of the first seal is adjacent to the second mating surface of the second seal and a first thermal expansion restricter is received simultaneously into the recesses of the first and second mating surfaces of the first and second seals, respectively.

36 Claims, 4 Drawing Sheets

SEAL ASSEMBLY WITH THERMAL EXPANSION RESTRICTER

BACKGROUND OF THE INVENTION

The present invention is directed generally to the field of seals for use in statically and dynamically sealing an annular cavity formed between two concentric tubes and more particularly to a restricter incorporated into a multi-element seal assembly to assist in restricting temperature-induced radial growth of the seals.

Seals take many shapes and forms and play a critical role in many devices. They are employed in settings wherein the components between which the seals are used are either static or dynamic with respect to one another. Moreover, the environment in which such seals are used may present extreme conditions such as high or low temperatures or transitions between the two, high pressure, friction, and chemical exposure. Seals used in this environment have a very short life, often failing after only a small number of cycles. Materials are therefore strategically selected to address one or more of the environmental conditions. One material may not address all conditions, but the combination of several seals made from different materials will typically address the majority of environmental conditions encountered.

A significant problem in designing seal assemblies for environments where conditions vary widely is that the materials selected for the seals may not all react in the same way to the environmental conditions. Such reactions may, in fact, be adverse to their sealing function. This difficulty is acutely manifested where extreme temperature changes are encountered. In such cases, the compensation for thermal conditions must be so great that if the seal is designed primarily to seal at higher temperatures, it loses its ability to seal at lower temperatures and vice versa.

Exemplary of these settings where such vexing environmental conditions are encountered are tools for use in subterranean downhole wells. Following the drilling of a downhole well, a string of casing is cemented in place to form an outer housing for the well hole. The casing is then perforated to permit the flow of fluids into the interior of the casing. Fluids are extracted from the casing via a string of conduits called production tubing or work tubes which are suspended concentrically within the casing. To permit the efficient extraction of fluids from the casing via the work tubes, or to permit the infusion of chemical inhibitors, stimulants or the like into the well hole, the work tubes are provided with a downhole well tool, generally located deep within the well, which acts as a valve to control the communication of fluids between the interior of the work tubes and the annular region between the work tubes and the casing.

Downhole well tools are well known in the drilling/extraction industry. Such downhole well tools are disclosed in, for example, U.S. Pat. No. 5,263,683 issued to Wong, entitled "Sliding Sleeve Valve," U.S. Pat. No. 5,316,084 issued to Murray et al. and U.S. Pat. No. 5,156,220 issued to Forehand et al., both entitled "Well Tool With Sealing Means." Such downhole well tools generally are provided with an outer housing which is an outer, generally tubular member, having threads on each end for connection to the work tubes and have a port or series of ports in the outer housing, generally arranged in a circumferential pattern around the midsection of the housing. Positioned concentrically and slidably within the housing is an inner, generally tubular member or sliding member, also having a port or series of ports arranged in a circumferential pattern around its midsection. The annular region between the outer housing and the sliding member is sealed at its upper end, above the housing ports, by a seal and at its lower end, below the housing ports, by another seal.

The valving function of the downhole well tool is accomplished by moving the sliding member longitudinally within the outer housing such that the ports of the sliding member are moved into and out of fluid communication with the housing ports. The sliding member is manipulated between the open and closed positions by means of a wireline, remedial coiled tubing, electric line, or any other well known mechanism controllable from atop the well hole. To permit fluid communication between the region within the work tubes and within the annular region outside the work tubes and within the casing, the sliding member is thus slidably moved to a position whereby the ports of the sliding member are located between the seals located above and below the housing ports. To discontinue or prevent fluid communication between the interior of the work tubes and the exterior of the work tubes, the sliding member is positioned whereby the ports of the sliding member are not located between the seals above and below the housing ports.

Essential to the valving function of the downhole well tool is a reliable sealing engagement between the sliding member and housing both above and below the ports on the housing.

Prior attempts to provide seals capable of withstanding the high temperatures and broad temperature ranges present in the down hole well environment have included the use of various types of polymeric material. Although polymeric materials have proven to be chemically resistant, after prolonged exposure to the high temperatures and broad temperature ranges present within the well hole, seals made from such materials will harden, become brittle, and will fail to provide sealing engagement between the sliding member and housing.

A significant improvement over single-seal designs is provided by prior art designs employing a combination of individual seal elements in a single seal assembly. Examples of such "nested" or multi-element seal assemblies generally known in the art are disclosed in U.S. Pat. No. 4,576,385 issued to Ungchusri et al., entitled "Fluid Packing Assembly With Alternating Diverse Seal Ring Elements" and in U.S. Pat. No. 5,309,993 issued to Coon et al., entitled "Chevron Seal for a Well Tool," the latter of which is incorporated herein in its entirety by reference. The advantage of such nested seal assemblies is that they permit the designer to combine seals made from several different materials into a single sealing unit. The materials employed can include a combination of metallic and non-metallic materials.

Nested seal assemblies provide the designer with the ability to partially compensate for the widely ranging conditions present in sealing applications, particularly in downhole wells. Whereas some of the individual seal components will function better at lower temperatures, others will function better at higher temperatures.

Thus, the purpose of using seal assemblies is to increase sealing efficiency relative to individual seal elements and to provide the opportunity to combine different types of seals and materials to accomplish sealing under a wide range of environmental conditions.

One significant drawback to any of the prior art seal assemblies, however, including nested seal assemblies, is that high temperatures and broad temperature ranges within the well bore, and of the downhole well tool itself, cause a large degree of thermally-induced growth in the individual seals and in the seal assembly as a whole. This thermally-induced seal growth occurs along the longitudinal axis of the downhole well and tool and in the radial (i.e., perpendicular to the longitudinal axis of the downhole well) direction. While longitudinal growth is not a particularly relevant factor insofar as seal longevity is concerned due to the ability to effectively restrain such growth, radial growth presents great challenges. Radial growth of seals results from the use of seal materials having high coefficients of thermal expansion.

When designing for sealing in environments where large variations in temperature occur, the degree of thermally-induced radial growth can be compensated for during design by sizing the various elements according to the amount of radial growth anticipated. However, as temperatures increase, or as the temperature range increases, compensation using sizing alone is insufficient to accommodate the degree of thermal growth that accompanies such conditions. This is due to the fact that seals cannot be sized to seal only at higher temperatures because the seals would not be capable of sealing at lower temperatures. Alternatively, sizing seals to accommodate the sealing function at lower temperatures can create a situation whereby thermally-induced radial growth creates too much interference at high temperatures. Such interference can cause seal damage or, in more extreme cases, can cause the downhole well tool to seize or lock up, whereby the sliding member cannot slide within the housing, thus leading to costly down time. Moreover, because seal assemblies may include seals made from disparate materials, thermally-induced radial growth is inconsistent among the various seal elements, thus complicating the design process.

The present invention improves on the seal assembly concept by providing a mechanism which restricts the thermal growth of adjacent seals in a seal assembly. The result is that, regardless of the non-metallic material used to make the seals, thermal growth of each seal is restricted, thus leading to greatly improved sealing capacity of the seal assembly, greater reliability, and lower operating costs.

BRIEF SUMMARY OF THE INVENTION

Briefly stated, the present invention is a seal assembly having a first seal with a first mating surface and a recess in the first mating surface, a second seal having a second mating surface and a recess in the second mating surface. The first mating surface of the first seal is adjacent to the second mating surface of the second seal. A first thermal expansion restricter is received simultaneously into the recesses of the first and second mating surfaces of the first and second seals, respectively.

In another aspect, the present invention is a downhole well tool of the type having an outer generally tubular member, and an inner generally tubular member slidably and concentrically positioned within the outer tubular member. The outer tubular member is perforated by an outer tubular port and the inner tubular member is perforated by an inner tubular port. The downhole well tool further includes first and second seal assemblies interposed in an annular region between the outer and inner tubular members. A sealed region is formed between the first and second seal assemblies when one of the outer tubular port and inner tubular port is disposed between the first and second seal assemblies. Each of the first and second seal assemblies includes first and second seals and a first thermal expansion restricter. The first seal has a first mating surface and a recess in the first mating surface. The second seal has a second mating surface and a recess in the second mating surface. The first mating surface of the first seal is adjacent to the second mating surface of the second seal. The first thermal expansion restricter is received simultaneously into the recesses of the first and second mating surfaces of the first and second seals, respectively.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings.

DETAILED DESCRIPTION OF THE INVENTION

Figure 1:
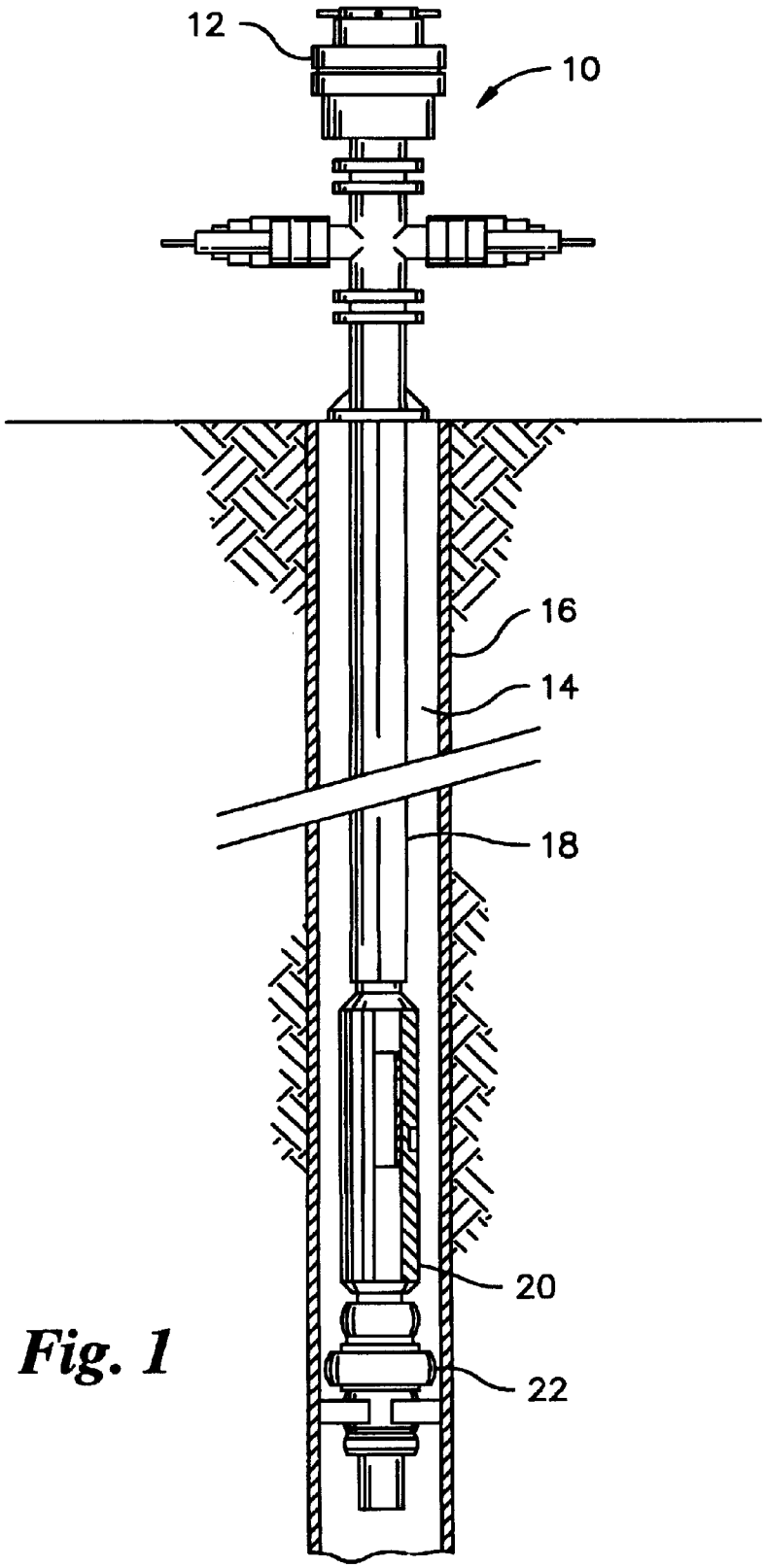
FIG. 1 is a longitudinal, partial sectional view of a subterranean well showing well hole communication apparatus positioned above a well packer during actual production of the well.

In the drawings, like numerals are used to indicate like elements throughout. With reference to FIG. 1, there is shown a wellbore tool apparatus in which the present invention may be used. It will be recognized by those of ordinary skill in the art that the present invention need not be limited in application to the wellbore tool apparatus as shown, but may have application in any situation wherein static or dynamic sealing under varying temperature conditions is required, including wellbore tools other than the type described hereinbelow, pumps, transmission systems, valving systems, etc.

As shown in FIG. 1, a well head 10 including a blow-out preventer 12 is positioned atop a well hole 14. The well hole 14 includes a casing 16 which generally extends from the top to the bottom of the well hole 14 and which, in essence, forms the lining of the well hole 14. For purposes of moving fluids into and out of the well hole 14, there is concentrically located within the casing 16 a wellbore fluid transfer tube 18, including, at the bottom thereof, a downhole well tool 20 and well packer 22.

Figure 2:
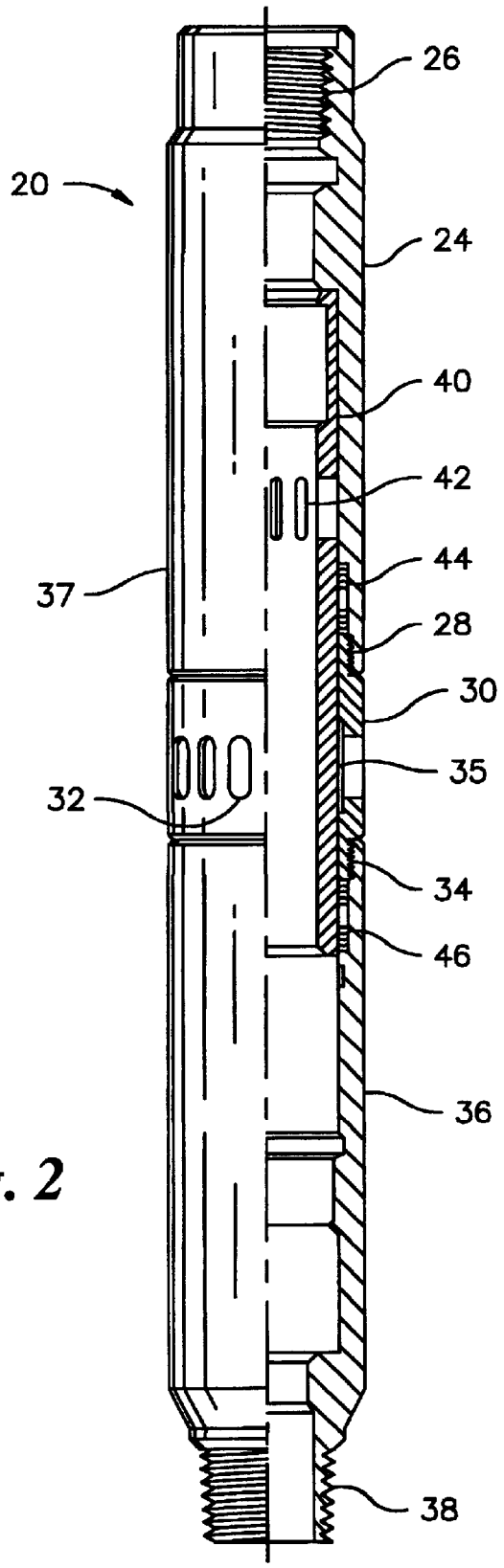
FIG. 2 is an enlarged, longitudinally extending quarter sectional view of the downhole well tool shown in FIG. 1 in a closed position.

With reference to FIGS. 1 and 2, the downhole well tool 20 includes a cylindrical upper housing 24, which, at its upper end, is secured to the fluid transfer tube 18 by threads 26. Secured to the lower portion of the upper housing 24 by threaded connection 28 is a cylindrical housing port section 30 which includes outer tubular ports or housing ports 32 perforating the housing port section 30 and disposed about the circumference of the housing port section 30. Secured to the lower end of the housing port section 30 by threaded connection 34 is a cylindrical lower housing 36. An additional fluid transfer tube 18 (not shown) or a well packer 22 may be connected to the lower housing 36 via threads 38. The assembly of the upper housing 24, housing port section 30 and lower housing 36 forms an outer generally tubular member or tubular housing 37 of the downhole well tool 20.

Concentrically and slidably positioned within the interior of the tubular housing 37 of the downhole well tool 20 is an inner generally tubular member or sliding member 40 having inner tubular ports or sliding member ports 42 perforating therethrough and disposed about the circumference of the sliding member 40. Interposed in the annular region formed between the interior cylindrical surface of the tubular housing 37 and the external cylindrical surface of the sliding member 40 to provide a sealing connection is a first seal assembly 44 located proximal to and above the housing ports 32 and a second seal assembly 46 located proximal to and below the housing ports 32. It will be recognized by those of ordinary skill in the art that the combination of the tubular housing 37, sliding member 40, and first and second seal assemblies 44, 46 provide the valving action of the downhole well tool 20.

A sealed region 35 is formed between the first and second seal asemblies 44, 46 when one of the housing ports 32 or sliding member ports 42 is not disposed between the first and second seal assemblies 44, 46. More particularly, as the downhole well tool 20 appears in FIG. 2, the downhole well tool 20 is in the "closed" position wherein there is no fluid communication between the interior of the downhole well tool 20 and the region within the casing 16 and external to the downhole well tool 20. Although the housing ports 32 are in fluid communication with the fluid within the casing 16 and external to the downhole well tool 20, the coaction of the first and second seal assemblies 44, 46 and the non-perforated portion of the sliding member 40 prevent fluid communication with the region within the downhole well tool 20. To provide fluid communication, the sliding member 40 is moved by a wireline, remedial coil tubing or other mechanism (not shown) well known to those of ordinary skill in the art to a position wherein the sliding member ports 42 are disposed between the first and second seal assemblies 44, 46. In this configuration, because the housing ports 32 and sliding member ports 42 are both located between the first and second seal assemblies 44, 46, there is fluid communication between the region within the downhole well tool 20 and the region external to the downhole well tool 20 and within the casing 16.

It is well recognized by those of ordinary skill in the art that the proper operation of the first and second seal assemblies 44, 46 is critical to the proper operation of the downhole well tool 20. Failure of one or both of these seal assemblies can cause great expense to the well operator insofar as the well head 10 (if used), fluid transfer tube 18, and downhole well tool 20 must be removed from the well hole 14, the downhole well tool 20 must be disassembled and repaired, and the entire apparatus must be reassembled and reinstalled.

Figure 3:
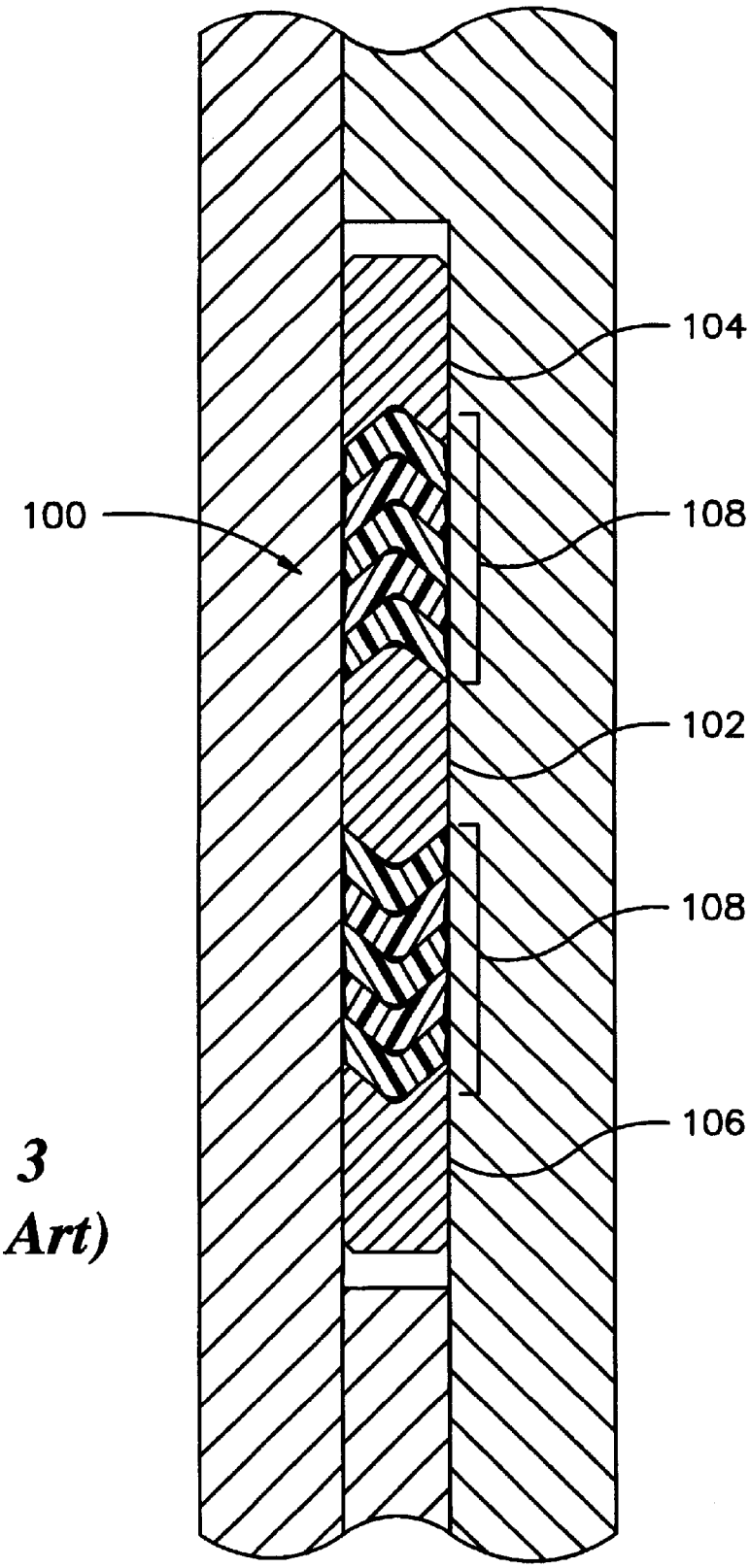
Fig. 3 (Prior Art)
FIG. 3 is a greatly enlarged view in torroidal cross-section of a downhole well tool showing a seal assembly in accordance with the prior art.

Referring now to FIG. 3, there is shown in torroidal cross section a typical prior art seal assembly 100 of the type used for the first and second seal assemblies 44, 46. As those of ordinary skill in the art will recognize, prior art seal assemblies 100 are typically composed of various individual seal elements 108 which are nested and cooperate to form a unitary seal when used in a downhole well tool 20. The prior art seal assembly 100 is shown with a center adapter 102, and first and second end adapters 104, 106. These adapters are generally used not to provide sealing, but are used to retain the seals 108. The seals 108 are typically chevron seal rings made from thermoplastic material. It is well known by those of ordinary skill in the art to combine seals 108 of different materials such that different operating conditions may be accommodated. Whereas the seals 108 can be designed, i.e., sized, to properly seal at lower operating temperatures, such seals may not seal effectively or may fail at higher operating temperatures due to the thermally-induced radial growth. Conversely, if the seals 108 are designed to properly seal at higher operating temperatures, the seals 108 may not seal at lower operating temperatures. Moreover, when seals of different material composition are used in a set or assembly as shown in FIG. 3, designing to accommodate thermally-induced radial growth of the seals 108 presents a significant obstacle to attaining optimal performance.

Figure 4:
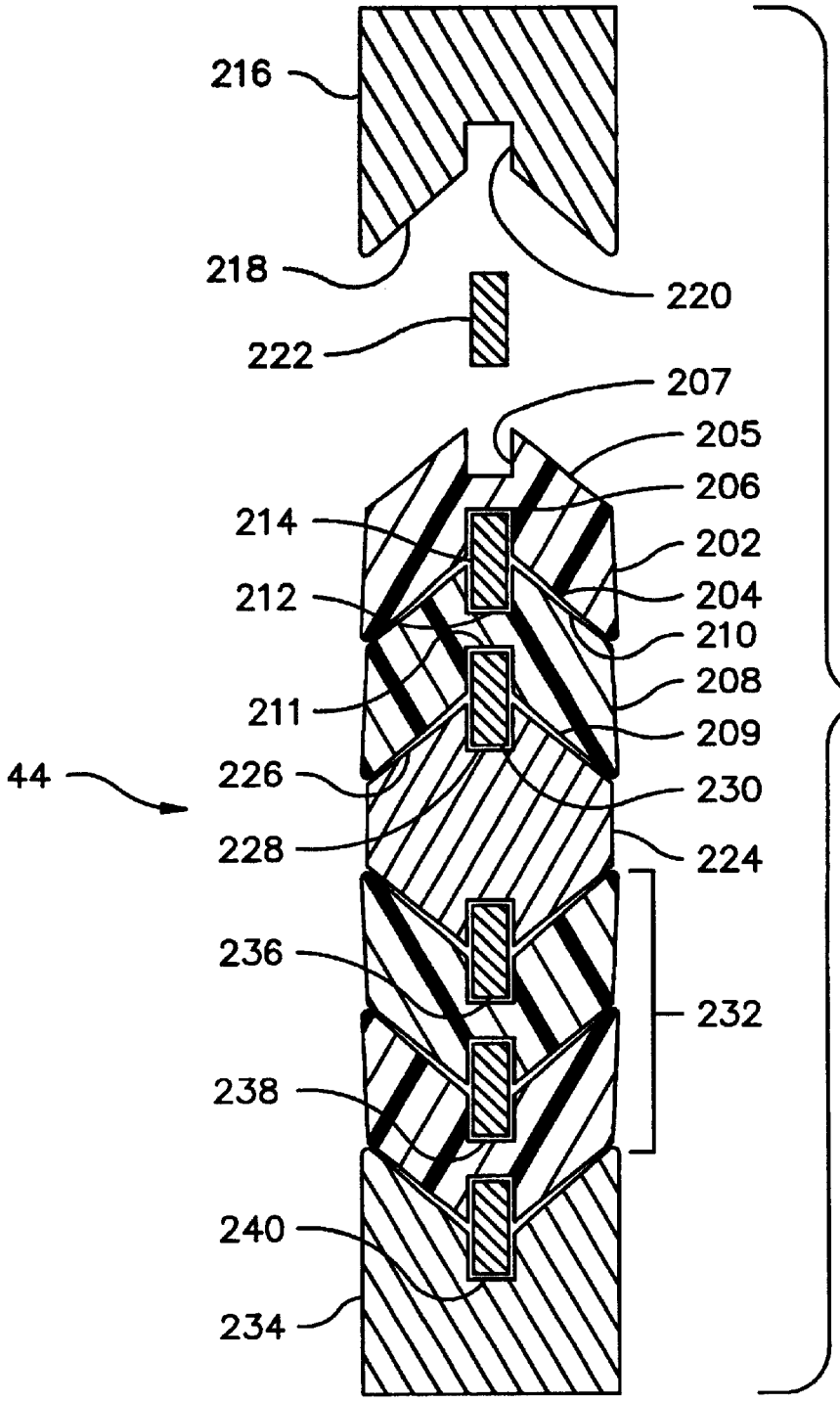
FIG. 4 is a greatly enlarged, partially-exploded, torroidal cross-sectional view of a preferred embodiment of the seal assembly of the present invention.

With reference to FIG. 4, there is shown a partially-exploded, torroidal cross-section of a preferred embodiment of the first low radial growth seal assembly 44 in accordance with the present invention. A first seal 202 includes a first mating surface 204 and a recess 206 in the first mating surface 204. It will be recognized by those of ordinary skill in the art that the first seal 202, and additional seals described hereinbelow, need not be rings as shown in FIG. 4, but alternatively may also be sleeves, split rings, packer or packing type elements, etc. without departing from the spirit and scope of the present invention. In such an alternative embodiment, there could be fewer or more seals than described hereinbelow. A second seal 208 has a second mating surface 210 and a recess 212 in the second mating surface 210. The first mating surface 204 of the first seal 202 is disposed adjacent to the second mating surface 210 of the second seal 208. The first and second seals 202, 208 will generally be made from a non-metallic material, preferably non-elastomeric, thermoplastic materials such as polytetrafluoroethylene-based composite thermoplastic available from Greene Tweed and Company, Kulpsville, Pa., under the trademark AVALON NO. 89 manufactured by their Advante Division in Garden Grove, Calif., or polyetherketone, also available from Greene Tweed and Company. Those of ordinary skill in the art will recognize that the first and second seals 202, 208 need not be made from the listed materials, but may be made from any of a number of seal materials well known in the art without departing from the spirit and scope of the invention.

A first thermal expansion restricter 214 is received simultaneously into the recesses 206, 212 of the first and second mating surfaces 204, 210 of the first and second seals 202, 208 respectively. The first thermal expansion restricter 214 is preferably made from a material that has thermal growth properties similar to those of the downhole well tool 20, particularly the upper and lower housings 24, 36, housing port section 30, and sliding member 40. Preferred materials include chemically-resistant metals such as stainless steel, Inconel (available from Inco Alloys located in Huntington, W.V., Elgiloy (available from Elgiloy Ltd. Partnership located in Elgin, Ill., or filled (including highly filled or reinforced) composites such as glass or carbon fiber with PEEK matrix, glass or carbon fiber with Ryton matrix, glass or carbon with Phenolix available from Automated Dynamics located in Schenectady, N.Y. The first thermal expansion restricter 214 need not be made of these materials, but to accomplish the objective of restricting thermally-induced radial growth of the low radial growth seal assembly 44, the first thermal expansion restricter 214 must be made from a material with a lower coefficient of thermal expansion than at least one of the seals 202, 208 into which the restricter 214 is recessed.

By nesting the first and second seals 202, 208 with the first thermal expansion restricter 214, thus causing the first and second seals 202, 208 and the first thermal expansion restricter 214 to act as a single unit, the thermally-induced radial growth of the first seal assembly 44 is thus greatly reduced. The first and second seals 202, 208 are, therefore, not free to expand due to thermal influences as would normally be expected. The thermal expansion restricter 214 of the preferred embodiment offers this significant advantage without affecting the geometric properties of the first seal assembly 44. In other words, the restricter 214 may be incorporated into the first seal assembly 44 without the need to change the geometry of any accommodating features of the downhole well tool 20.

Those of ordinary skill in the art will recognize that any number of seals may be combined to form the first seal 44 without departing from the scope and spirit of the invention.

In a preferred embodiment, the first mating surface 204 of the first seal 202 is shaped substantially correspondingly with the second mating surface 210 of the second seal 208. The first and second seals 202, 208 are preferably chevron seals. It will be recognized by those of ordinary skill in the art that the first and second seals 202, 208 need not be chevron seals, but can have virtually any radial cross-sectional shape, such as round, square, or a hybrid shape that is essentially a composite of different shapes.

In the preferred embodiment, the first seal 202 further includes a second mating surface 205 and a recess 207 in the second mating surface 205. The first seal assembly 44 further includes a terminal adapter 216 having a first mating surface 218 and a recess 220 in the first mating surface 218, the first mating surface 218 of the terminal adapter 216 being adjacent to the second mating surface 205 of the first seal 202. A second thermal expansion restricter 222 is received simultaneously into the recesses 220, 207 of the first and second mating surfaces 218, 205 of the terminal adapter and first seal 216, 202, respectively. Preferably, the first mating surface 218 of the terminal adapter 216 is shaped substantially correspondingly with the second mating surface 205 of the first seal 202. Those of ordinary skill in the art will recognize that adjacent surfaces of adjacent seal members need not be shaped substantially correspondingly, but may have gaps therebetween (not shown). Such gaps can be considered by the designer and the size of the restricter can be adjusted accordingly. Again, preferably, the thermal expansion restricter are metallic or filled composite and the first and second seals 202, 208 are non-metallic chevron seals.

In a further preferred embodiment, the second seal 208 further includes a first mating surface 209 and a recess 211 in the first mating surface 209. The first seal assembly 44 further includes a center adapter 224 having a second mating surface 226 and a recess 228 in the second mating surface 226. The second mating surface 226 of the center adapter 224 is adjacent to the first mating surface 209 of the second seal 208. A third thermal expansion restricter 230 is received simultaneously into the recesses 228, 211 of the center adapter 224 and second seal 208, respectively. Preferably the second mating surface 226 of the center adapter 224 is shaped substantially correspondingly with the first mating surface 209 of the second seal 208. Again, preferably, the thermal expansion restricter are metallic or filled composite and the first and second seals 202, 208 are non-metallic chevron seals.

In the preferred embodiment shown in FIG. 4, the first seal assembly 44 has a second, opposing set of seals 232 mirroring the first and second seals 202, 208. The individual seals of the opposing set of seals 232 are interlocked to each other and to the center adapter 224 and a second terminal adapter 234 by restricter 238, 236, and 240 respectively. It will be appreciated by those of ordinary skill in the art that the first seal assembly 44 need not have an opposing set of seals 232, first and second terminal adapters 216, 234, or center adapter 224, but may be limited to just a first seal 202 and second seal 208 and a first restricter 214. Any number of additional seals and restricters (not shown) may be added. Moreover, in a further embodiment (not shown), the first seal assembly 44 could include first and second terminal adapters 216, 234 and any number of individual seals interlocked by restricter. The critical requirement of the present invention for providing the thermal-growth-restriction feature is to interlock individual seals with restricter to prevent thermally-induced radial growth of the seals.

The second seal assembly 46 is generally identical to the first seal assembly 44. Accordingly, the description of the first seal assembly 44 is equally applicable to the second seal assembly 46.

It will be appreciated by those skilled in the art that changes could be made to the embodiments described above without departing from the broad inventive concept thereof. As stated above, the present invention is not limited in application to downhole well tools but may have application in any configuration wherein sealing between concentric tubular members is desired. It is understood, therefore, that this invention is not limited to the particular embodiments disclosed, but it is intended to cover modifications within the spirit and scope of the present invention as defined by the appended claims.

What is claimed is:

1. A seal assembly comprising:

a first seal having a first mating surface and a recess in the first mating surface;

a second seal having a second mating surface and a recess in the second mating surface, the first mating surface of the first seal being in mating engagement with the second mating surface of the second seal;

a first thermal expansion restricter received simultaneously into the recesses of the first and second mating surfaces of the first and second seals, respectively.

2. The seal assembly according to claim 1, wherein the first mating surface of the first seal is shaped substantially correspondingly with the second mating surface of the second seal.

3. The seal assembly according to claim 1, wherein the seals are chevron seals.

4. The seal assembly according to claim 1, wherein the seals are non-metallic.

5. The seal assembly according to claim 1, wherein the first thermal expansion restricter is metallic.

6. The seal assembly according to claim 1, wherein the first thermal expansion restricter is filled composite.

7. The seal assembly according to claim 1, wherein the first seal further includes a second mating surface and a recess in the second mating surface, the seal assembly further comprising:

a terminal adapter having a first mating surface and a recess in the first mating surface, the first mating surface of the terminal adapter being adjacent to the second mating surface of the first seal; and a second thermal expansion restricter received simultaneously into the recesses of the first and second mating surfaces of the terminal adapter and first seal, respectively.

8. The seal assembly according to claim 7, wherein the first mating surface of the terminal adapter is shaped substantially correspondingly with the second mating surface of the first seal.

9. The seal assembly according to claim 7, wherein the seals are chevron seals.

10. The seal assembly according to claim 7, wherein the seals are non-metallic.

11. The seal assembly according to claim 7, wherein the thermal expansion restricters are metallic.

12. The seal assembly according to claim 7, wherein the thermal expansion restricters are filled composite.

13. The seal assembly according to claim 7, wherein the second seal further includes a first mating surface and a recess in the first mating surface, the seal assembly further comprising:

a center adapter having a second mating surface and a recess in the second mating surface, the second mating surface of the center adapter being adjacent to the first mating surface of the second seal; and a third thermal expansion restricter received simultaneously into the recesses of the second and first mating surfaces of the center adapter and second seal, respectively.

14. The seal assembly according to claim 13, wherein the second mating surface of the center adapter is shaped substantially correspondingly with the first mating surface of the second seal.

15. The seal assembly according to claim 13, wherein the seals are chevron seals.

16. The seal assembly according to claim 13, wherein the seals are non-metallic.

17. The seal assembly according to claim 13, wherein the thermal expansion restricters are metallic.

18. The seal assembly according to claim 13, wherein the thermal expansion restricters are filled composite.

19. A downhole well tool of the type having an outer generally tubular member, an inner generally tubular member slidably and concentrically positioned within the outer tubular member, an outer tubular port perforating the outer tubular member, an inner tubular port perforating the inner tubular member, and first and second seal assemblies interposed in an annular region between the outer and inner tubular members, a sealed region being formed between the first and second seal assemblies when one of the outer tubular port and inner tubular port is not disposed between the first and second seal assemblies, the first and second seal assemblies each comprising:

a first seal having a first mating surface and a recess in the first mating surface;

a second seal having a second mating surface and a recess in the second mating surface, the first mating surface of the first seal being adjacent to the second mating surface of the second seal;

a first thermal expansion restricter received simultaneously into the recesses of the first and second mating surfaces of the first and second seals, respectively.

20. The seal assembly according to claim 19, wherein the first mating surface of the first seal is shaped substantially correspondingly with the second mating surface of the second seal.

21. The seal assembly according to claim 19, wherein the seals are chevron seals.

22. The seal assembly according to claim 19, wherein the seals are non-metallic.

23. The seal assembly according to claim 19, wherein the first thermal expansion restricter is metallic.

24. The seal assembly according to claim 19, wherein the first thermal expansion restricter is filled composite.

25. The seal assembly according to claim 19, wherein the first seal further includes a second mating surface and a recess in the second mating surface, the seal assembly further comprising:

a terminal adapter having a first mating surface and a recess in the first mating surface, the first mating surface of the terminal adapter being adjacent to the second mating surface of the first seal; and a second thermal expansion restricter received simultaneously into the recesses of the first and second mating surfaces of the terminal adapter and first seal, respectively.

26. The seal assembly according to claim 25, wherein the first mating surface of the terminal adapter is shaped substantially correspondingly with the second mating surface of the first seal.

27. The seal assembly according to claim 25, wherein the seals are chevron seals.

28. The seal assembly according to claim 25, wherein the seals are non-metallic.

29. The seal assembly according to claim 25, wherein the thermal expansion restricters are metallic.

30. The seal assembly according to claim 25, wherein the thermal expansion restricters are filled composite.

31. The seal assembly according to claim 25, wherein the second seal further includes a first mating surface and a recess in the first mating surface, the seal assembly further comprising:

a center adapter having a second mating surface and a recess in the second mating surface, the second mating surface of the center adapter being adjacent to the first mating surface of the second seal; and a third thermal expansion restricter received simultaneously into the recesses of the second and first mating surfaces of the center adapter and second seal, respectively.

32. The seal assembly according to claim 31, wherein the second mating surface of the center adapter is shaped substantially correspondingly with the first mating surface of the second seal.

33. The seal assembly according to claim 31, wherein the seals are chevron seals.

34. The seal assembly according to claim 31, wherein the seals are non-metallic.

35. The seal assembly according to claim 31, wherein the thermal expansion restricters are metallic.

36. The seal assembly according to claim 31, wherein the thermal expansion restricters are filled composite.

* * * * *